US008393351B2

(12) United States Patent
Carter et al.

(10) Patent No.: US 8,393,351 B2
(45) Date of Patent: Mar. 12, 2013

(54) DUAL AUTOMATIC DRYER AND WASHING MACHINE PROTECTIVE BASIN

(75) Inventors: Frankie Lee Carter, Dana Point, CA (US); Paul Rahmes, Ladera Ranch, CA (US)

(73) Assignee: Driptite, Inc., Laguna Beach, CA (US)

( * ) Notice: Subject to any disclaimer, the term of this patent is extended or adjusted under 35 U.S.C. 154(b) by 174 days.

(21) Appl. No.: 12/692,608

(22) Filed: Jan. 23, 2010

(65) Prior Publication Data

US 2011/0180153 A1 Jul. 28, 2011

(51) Int. Cl.
*F16L 55/07* (2006.01)
*G08B 21/00* (2006.01)

(52) U.S. Cl. ..... 137/312; 220/571; 222/108

(58) Field of Classification Search ..... 137/312; 220/571; 222/108
See application file for complete search history.

(56) References Cited

U.S. PATENT DOCUMENTS 4,903,723 A * 2/1990 Sublett ..... 137/312
5,452,739 A * 9/1995 Mustee et al. ..... 220/571
7,124,772 B1 * 10/2006 Browning ..... 137/312

* cited by examiner

*Primary Examiner* — Kevin Lee
(74) *Attorney, Agent, or Firm* — David S Nagy

(57) ABSTRACT

The Dual Automatic Dryer and Washing Machine Protective Basin is a drip pan sized to fit both a washer and dryer, and to contain leakage from both appliances. The position of the washer and dryer can safely be swapped, and the pan can optionally be provided with an opening directly over a floor drain, which now need not be located under the washing machine. The front wall of the basin can be sized to clear a door or pedestal drawer; alternatively, the basin can have raised spots supporting the feet of the appliance or pedestal, so as to lift doors or drawers above the front wall.

17 Claims, 5 Drawing Sheets

DUAL AUTOMATIC DRYER AND WASHING MACHINE PROTECTIVE BASIN

BACKGROUND OF THE INVENTION

This invention is directed to a Dual Automatic Dryer and Washing Machine Protective Basin, which protects both dryer and washing machine and the underlying surface on which they are supported from drippage, and is effective with both front and top loaders installed side-by-side.

Drippage has historically been handled in differing ways. Appliance drip pans and specifically washing machine and dishwasher drip pans are well known in the prior art. An example of a dishwasher drip pan is U.S. Pat. No. 3,096,781 to Roidt. The Roidt device is used to collect drippage from a built-in dishwasher, and redirect the drippage to the exterior of the building. The Roidt drip pan is comprised of a flat bottom with four vertical walls, i.e., front, rear and side walls. Each corner of the flat bottom is fitted with a foot which supports the drip pan in a level position slightly elevated above the floor. The bottom of the drip pan has openings through which lag screws pass and secure the drip pan into the floor. A drainage opening is provided in either the bottom or rear wall. The drip pan is first installed on the underlying surface, and the dishwasher is then placed within the walls of the device. When installed, a drainage tube is attached to the drainage opening which serves to conduct any leakage through an outside wall to the exterior of the building. The drip pan operates by intercepting any drainage before it reaches the floor, confining the drainage to the area beneath the dishwasher, and conducting the drainage through an opening to the exterior of the building.

The Roidt drip pan is not suitable as a protective drip pan for an automatic front loading dryer and washing machine unit for several reasons. First, it is not designed for a dual, side-by-side automatic dryer and washing machine unit. Second, the Roidt drip pan has a number of structural features which require a complex molding process and assembly of separate components into the final product. The features include small feet for elevating the bottom of the pan above the floor, openings for drainage and attachment of the drip pan to the floor, collars for the attachment openings and the means for attaching the drainage tubing to the drainage opening. These structural features increase the cost of the Roidt drip pan, and the screw openings in the bottom of the pan pose the danger of the failure of any seal between the openings and the lag screws, with the attendant danger of leakage at that point.

Third, the Roidt drip pan requires modification of the building for installation of an attached drain tube which conducts the drainage to the exterior of the building. Installation also requires tubing connections and installation of lag screws and support blocks. These installation requirements add cost and complexity to what is at first glance a rather simple invention.

Fourth, the Roidt drip pan fails to provide any protection for the front or top loading automatic dryer and washing machine units by failing to alert the occupant of the building that leakage is occurring. Small amounts of leakage can indicate impending serious failure of the washing machine unit or possibly lead to serious failure if unchecked (e.g. seal failure contributing to bearing failure, thermostat or blower failure). Since the building occupant is not alerted to take corrective action, the condition is likely to worsen, possibly leading to greater damage than if the drip pan were not used.

Fifth, the Roidt drip pan could lead to greater damage to the building than if no drip pan were used at all, since continual, undetected drainage to the immediate vicinity of a building exterior has the potential to cause damage to the foundation or sub floors of the building.

Finally, the Roidt pan poses another potential hazard to the building: the open drainage tube leading directly to the exterior of the building provides a direct route for pests from the exterior to the interior of the building.

A washing machine water catcher is described in U.S. Pat. No. 3,304,950 to Hubert. The Hubert water catcher is comprised of a bottom wall attached to vertical rear inside walls, and a removable front wall. The bottom wall of the water catcher is fitted with runner plates over which the base of the washing machine slides during installation. A separate drain valve is provided in the front wall for drainage of collected water. The inside area of the water catcher is larger than the base of the washing machine to allow the base of the washing machine to fit completely within the water catcher. The Hubert water catcher is installed by removing the washer, placing the water catcher on the floor, removing the front wall of the water catcher, sliding the washing machine into the water catcher, and replacing the front wall.

The Hubert water catcher is not suitable for use as a dual automatic dryer and washing machine protective basin for a number of reasons. First, the Hubert water catcher allows drainage to accumulate beneath a single appliance that would be unseen and otherwise unnoticed by the occupant of the building. The accumulation of drainage beneath a dual side-by-side dryer and washer unit can lead to mildew and mold, and may provide breeding sites and sustenance for insects or other pests in a room of the house where cleanliness is of great importance. The Hubert invention thus fails to prevent or cure some of the major damaging effects of drainage from an automatic dual dryer and washing machine unit. In addition, the spigot protruding from the front wall would be a tripping hazard for the buildings occupants.

The Hubert water catcher also has structural features which require a complex molding process in the assembly of separate components, adding to the cost of the final product. The features include cleats molded into the bottom and side walls to hold the runner plates, the hole and spigot assembly in the front wall, and precisely sized channels in the side walls to receive and seal the edges of the removable front wall.

A refrigerator drip pan is disclosed in U.S. Pat. No. 1,584,175 to Irons. The Irons refrigerator drip pan is a container for collecting and containing condensation and drip from the waste pipe of the ice chamber of the refrigerator. It is comprised of a rectangular box with a recessed lid. The lid has two recessed channels to guide the drips from their point of impingement near the center of the lid to holes at the front corners of the lid, where the drips fall into the box. A roller is fitted near the rear of the bottom of the pan to aid in removing the pan from beneath the refrigerator. The drip pan is installed completely beneath the refrigerator, and is hidden from view by the lower front panel of the appliance. Periodically, the box must be removed and emptied. The pan is fitted with an overflow hole in the front wall to remind the forgetful building occupant to remove and empty the filled pan. The overflow discharges to the area beneath the refrigerator behind the front cover.

The Irons refrigerator drip pan is unsuitable for use as a protective drip pan for a dual side-by-side automatic dryer and washing machine unit. First, the Irons pan is too tall to fit beneath a standard automatic, dryer and washing machine. Next, the Irons pan is designed to accumulate drainage in an enclosed area beneath the appliance, unseen and otherwise unnoticed by the occupant of the building. The accumulation of drainage beneath a dual automatic dryer and washing machine can lead to mildew and mold, and may provide breeding sites and sustenance for insects or other pests. The Irons invention thus fails to prevent or cure some of the major damaging effects of drainage from a washing machine or dryer.

The Irons drip pan has a number of structural features which require complex forming steps and assembly of separate components into the final product. These features include recessed channels in the lid, an internal baffle, an overflow hole in the front wall, a roller on the bottom of the pan, and a handle on the front of the pan. These structural features increase the cost of the Irons pan. When filled, the Irons pan discharges through the overflow hole in the front wall to the closed area beneath the refrigerator. If used with a washer and dryer, the user would not be alerted to the presence of drainage from the appliance until the pan fills, overflows, and the drainage spreads from beneath the front covers of both appliances. The building occupant is not alerted that the machine is malfunctioning for a potentially long time. The delay could lead to damage to both the automatic dryer and washing machine and the floor beneath.

Another drip pan for refrigerators is also disclosed in U.S. Pat. No. 1,057,654 to Menzl. The Menzl drip pan is a pan mounted on a tiltable support in such a way as to automatically tilt and slide forward from beneath the refrigerator when a predetermined amount of water has accumulated in the pan. The Menzl drip pan was designed for refrigerators which were "ice boxes", and which had a slow continuous discharge of water from the ice box drain pipe as ice in the ice storage chamber slowly melted. It was therefore convenient and useful for an ice box drip pan to accumulate a quantity of water from the melted ice for the convenience of the user.

Other prior art patents exist which relate to drip pans. U.S. Pat. No. 2,479,000 to Buczkowski is directed to a drip pan for a toilet flush tank. U.S. Pat. No. 4,527,707 to Heymann et al. describes a tray for use inside an automatic dishwasher to catch debris from the glass tray. U.S. Pat. No. 3,662,912 to Calle describes a drip tray for use inside a refrigerator, beneath the freezer compartment. These inventions are not suitable for use as a protective drip pan for a dual front or top loading automatic dryer and washing machine unit for reasons previously cited with respect to the Roidt, Hubert, and Irons patents. Therefore, a need exists for a dryer and washing machine system which protects both the dryer and washing machine and the underlying surface on which it is supported, from leakage liquid emitted from both units.

Dual Automatic Dryer and Washing Machine Protective Basin

The Dual Automatic Dryer and Washing Machine Protective Basin is different from the Bates, Jr. protective automatic dishwashing system for an automatic dishwasher, U.S. Pat. No. 5,224,508. The Bates, Jr. protective automatic dishwashing system is for an automatic dishwasher for the kitchen and not for a dual automatic dryer and washing machine. Secondly it does not catch all of the water that the dual combination washer and dryer basin will accommodate and hold. A standard dishwasher only uses 20 gallons, and the Bates, Jr. system is designed to hold only that amount. Therefore, the Bates, Jr. system is not designed to hold the capacity of a normal 38-gallon washing machine should a leak develop. In addition, if the water evaporative system on a dryer failed at the same time, this would only add more water to the already overflowing Bates Jr. system, again causing damage to the floors and sub floors while also creating a potential hazardous living area for the homeowner due to toxic mold development.

The Dual Automatic Dryer and Washing Machine Protective Basin system, on the other hand, will not overflow even if both the automatic washer and dryer systems fail at the same time and leak all of their capacity into the pan, as it is designed with a capacity sufficient to absorb so great a discharge. This offers a worry-free situation for the homeowner. The new, water- and energy-efficient front-loading automatic washing machines are, unfortunately, notorious for water leakage. As they age, door seals can become less effective, and water churned up against the door can work its way past hardened seals.

As mentioned in the prior invention of Hubert, U.S. Pat. No. 3,304,950, water catcher apparatus, the Dual Automatic Dryer and Washing Machine Protective Basin system is different from Hubert's apparatus because the present invention catches drips and leaks from both the front loading dryer and washing machine, which means it is apparent by the prior art that the Hubert invention is made only for a washing machine by itself and not an automatic dryer and washing machine side-by-side. The present invention, the Dual Automatic Dryer and Washing Machine Protective Basin system holds the water capacity of both if both appliances were to leak or fail at different times or even at the same time, catching all the water from both appliances and not just one appliance.

Different from the prior invention, the present invention is thicker and made of a more durable material which is applied in the manufacturing process. The aforementioned prior drip pan apparatus for the washing machine is not thick enough to provide adequate durability, causing the product to crack or break sometimes within months of being installed in the new house by housing developers or building contractors. The lack of using the proper material therefore can cause a safety hazard for the new homeowner and the building contractor alike. The new homeowner could step on the product by accident while loading the washing machine, cracking it and making it susceptible to leakage. The prior drip pan apparatus, in addition to the material drying out from the UV rays from natural light or perhaps the UV from a light bulb, could cause a potential insurance liability to the contractor as well as a new homeowner if the washing machine should leak or overflow spilling water to a cracked, broke or damaged pan, in turn causing damage to the flooring and sub flooring of the house and or building.

DETAILED DESCRIPTION OF THE INVENTION

Figure 1:
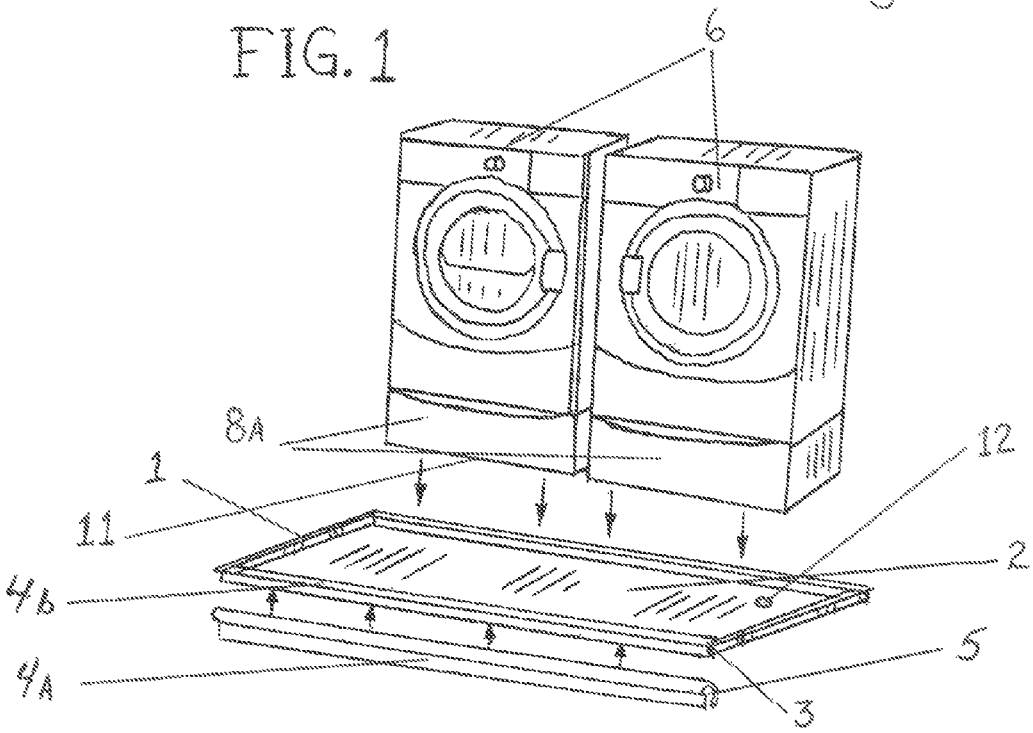
FIG. 1 shows the invention as it is being installed
Figure 3:
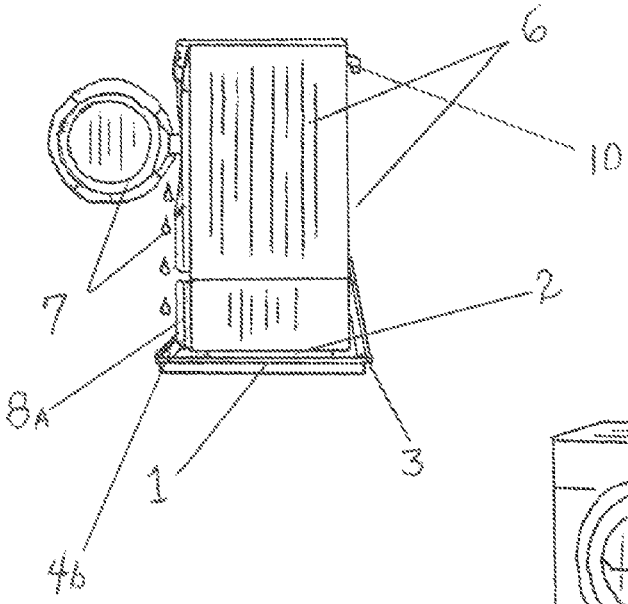
FIG. 3 is a three-quarter side view of yet another embodiment of the invention

Reference numerals are shown in parentheses, and refer to the Figure most nearly preceding them in the text. This invention is a Dual Automatic Dryer and Washing Machine Protective Basin system (The No-Re-Plumb Dual Automatic Dryer and Washing Machine Protective Basin™) for the new front or top loading side-by-side automatic dryer and washing machines—FIG. 4 (6) with or without a pedestal drawer (8*a*), being capable of catching and retaining or safely diverting leaks from both automatic dryer and washing machine if one or both appliances were to leak from the front door seals FIG. 3 (7) at the same time while washing and drying clothes or perhaps due to the mechanical failure while the washing machine is filling FIG. 4 (11) or perhaps the dryer heat evaporative and or steam system FIG. 3 (10) fails, in addition to having the present invention lower in height (4*b*) in order for the pedestal drawer (8*b*) to be able to clear the front wall of the basin—it can easily be seen that the height of the front wall (or any other wall, for that matter) can be modified down to any height to clear a pedestal drawer or for any other clearance issue, albeit at the expense of total basin capacity. FIG. 1 (6) shows how the washer and dryer can be swapped from either side without having to re-plumb the drain. This also allows the customer choice of door openings FIG. 3 (7) due to different cabinet configurations or if the user has a preference of left or right handed position while still allowing for the protective basin to function as intended.

Still referring to the drawings in which the various features are numbered, the Dual Automatic Dryer and Washing Machine Protective Basin system is a water catching protective basin device with a substantially flat bottom (2), and three or more raised edges (1). In its simpler form shown in FIG. 1, it is simply a pan with a flat bottom and four identical side walls. Optionally, this pan is to fit flush into the floors of a laundry room that will fit both automatic dryer and washing machine side by side in FIG. 4, while these walls are low enough (4*b*) to accommodate the pedestal drawer (8*b*) of the frontloading automatic dryer and washing machines/side-by-sides (6) in the event of a drip or leak or failed system in either the dryer or washing machine or both.

Figure 4:
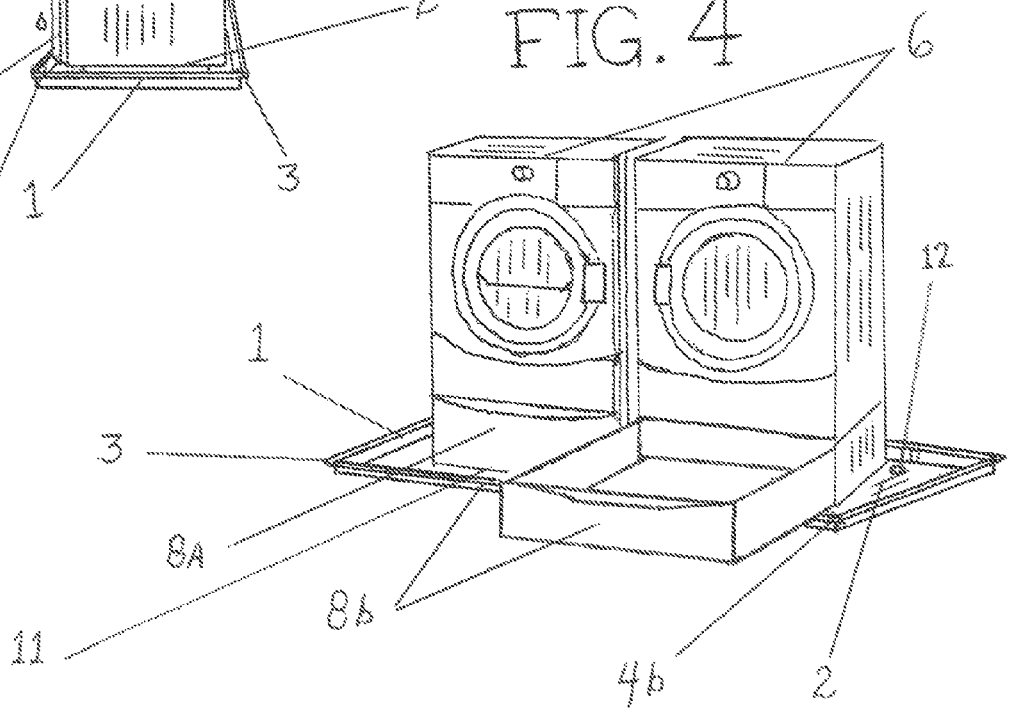
FIG. 4 is a three-quarter view of yet another embodiment of the invention showing that capability of either the dryer or washing machine pedestal drawer and the invention low enough and yet large enough to accommodate these features of both appliances or of both automatic dryer and washing machine
Figure 5:
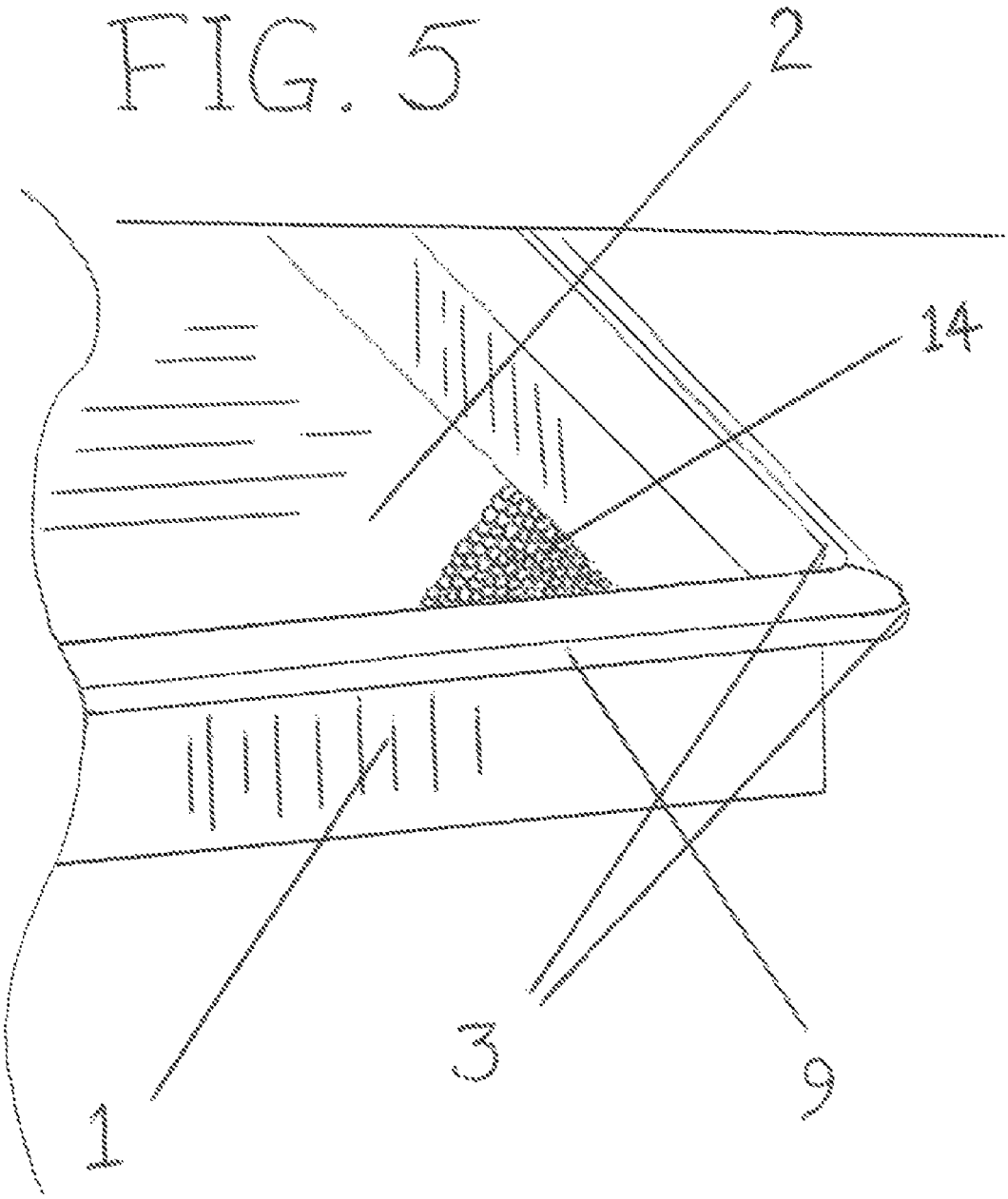
FIG. 5 is a detailed view of the Safety No-Stub Corners™, showing the thickness and durability of the product and also the Anti-Vibe Diffusion Bumps™.
Figure 6:
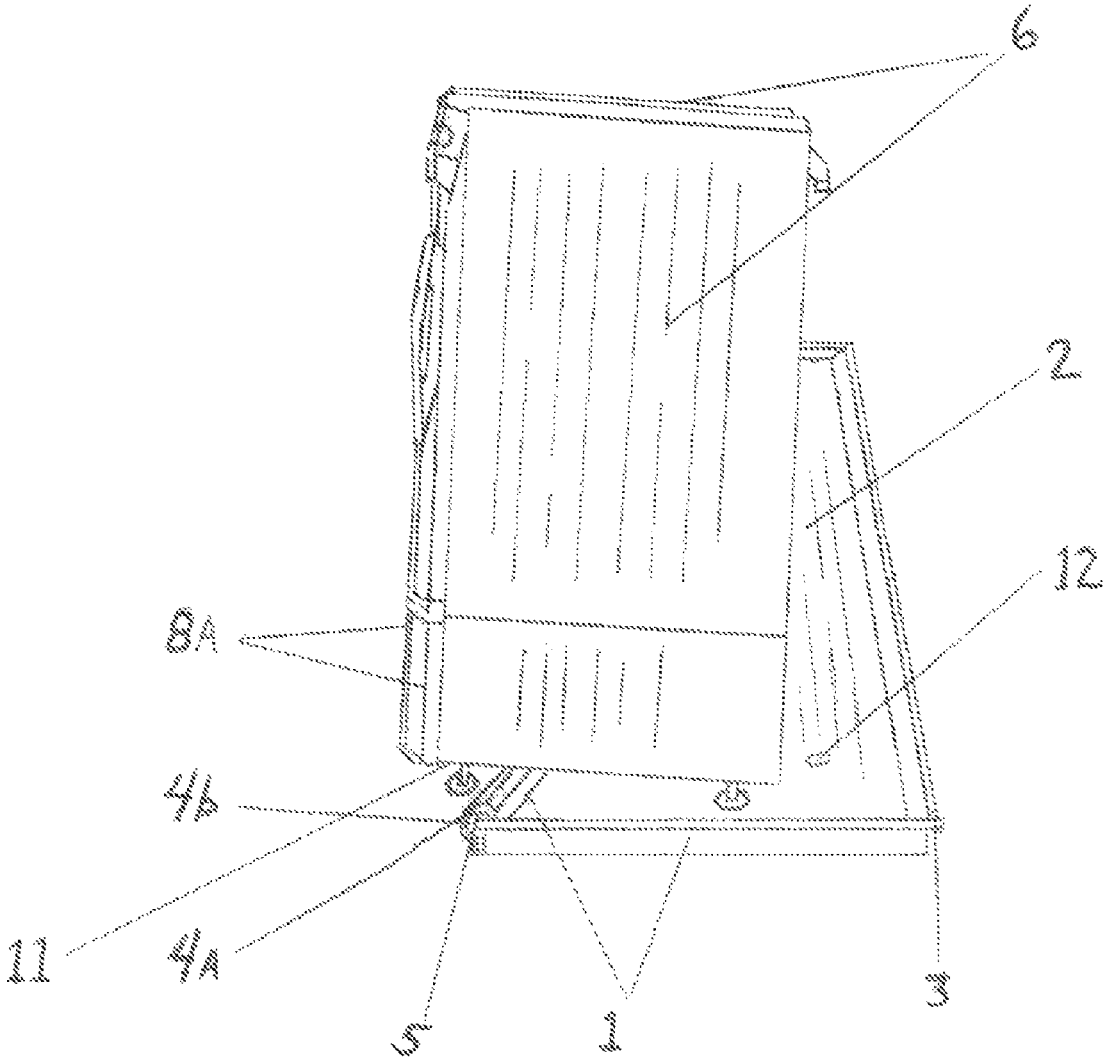
FIG. 6 is a side view of the service and repair strip safety device in use, adding strength to the front sidewall

In addition to having the base of the pan and it sides designed to fit both dryer and washer side by side, FIG. 4, it may optionally be helpful to equip the top edges with Safety No-Stub Corners™ of ¼" approximate radius FIG. 5 (3) on one or more raised edges or sidewalls (1) with a greater thickness in the material formed around the top edges and corners (9) (3) for injury prevention measures. Those skilled in the art know that the radius could be greater or smaller. It may also be optionally helpful to equip the top edge FIG. 2 (5) with a rigid formed material that form-fits around the front of one or more raised edges that is a repair strip safety device that snaps FIG. 6 (5) or is added to the front of one or more said sidewalls or raised edges FIG. 6 (4*a*) (4*b*) to better assist service and repair of either appliances if they have to be pulled out and repaired FIG. 6 adding strength to the one or more of the raised edges or sidewalls.

Figure 2:
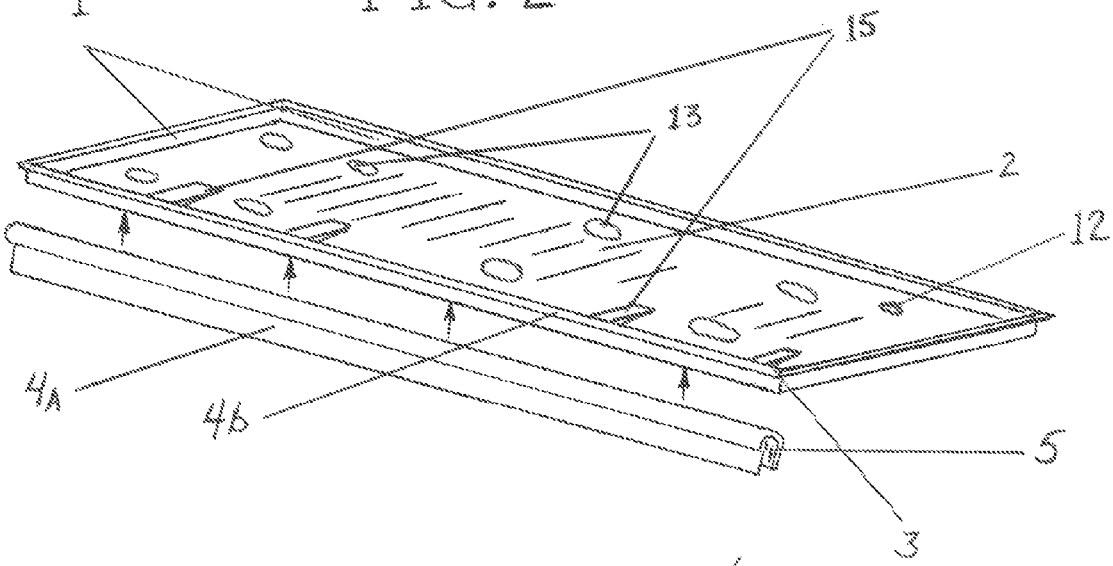
FIG. 2 is a three-quarter overhead view of one embodiment of the invention which includes the built-in Easy-Slide Wedges™ and the Anti-Vibe Damping Pads™.
Figure 7:
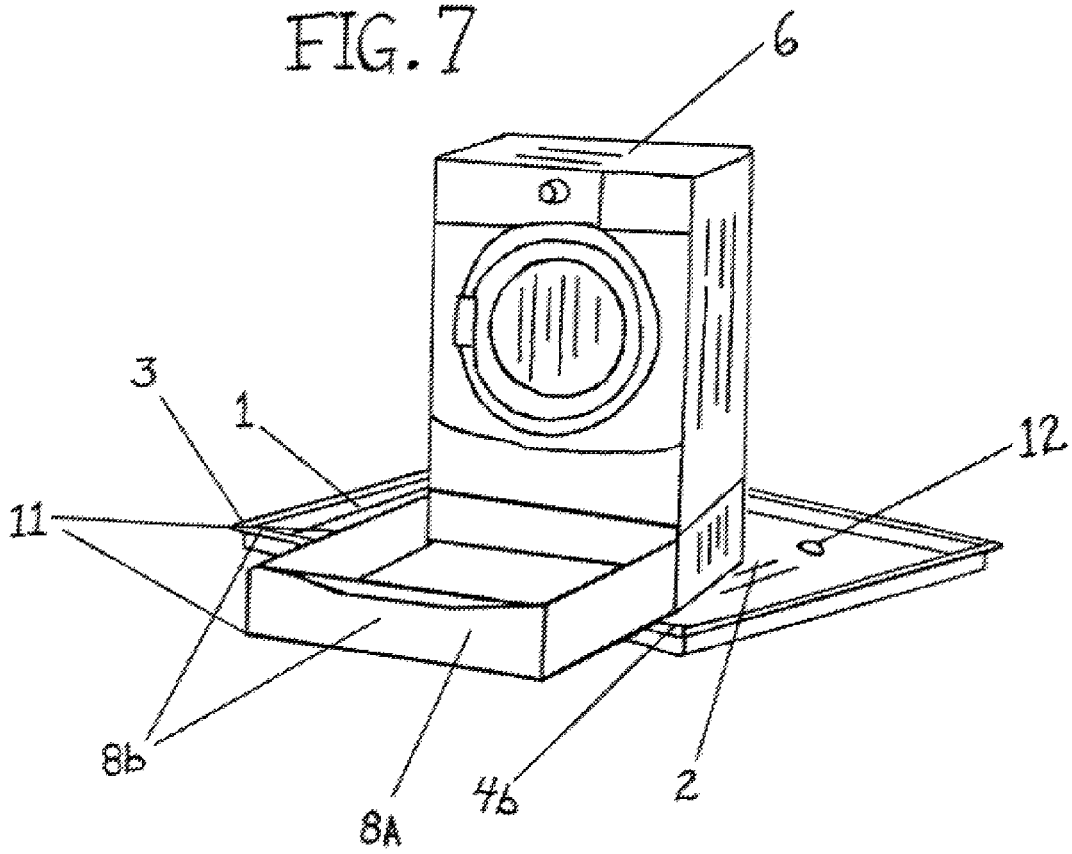
FIG. 7 is a depiction of the invention adapted to a single appliance, or a stackable pair, with front wall low enough to clear a pedestal drawer
Figure 8:
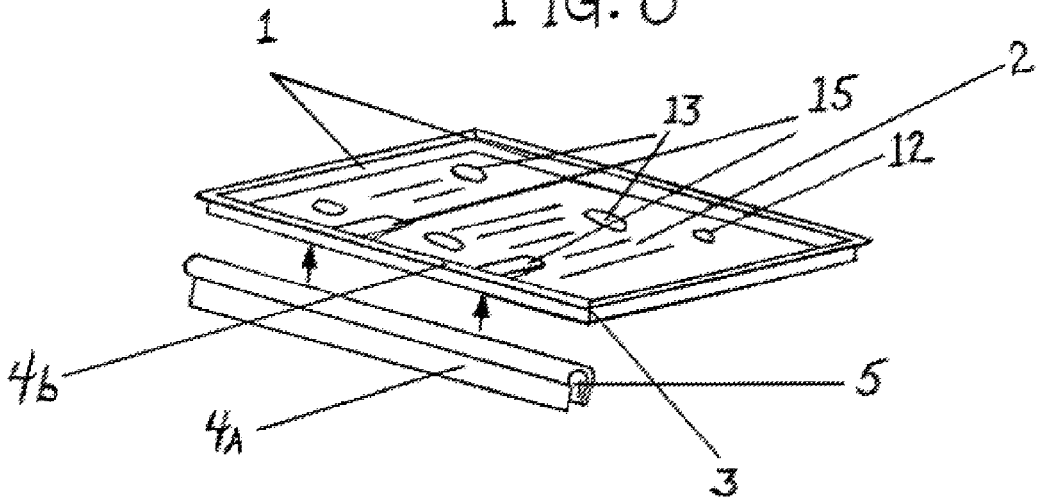
FIG. 8 is a three-quarter overhead view of one embodiment of the invention adapted to a single appliance, or a stackable pair, which includes repair strip safety device, the built-in Easy-Slide Wedges™ and the Anti-Vibe Damping Pads™

FIGS. 7 and 8 show the invention adapted for use with a single appliance—this same adaptation would serve for a stackable pair of appliances—and are analogous to FIGS. 4 and 2, respectively.

FIG. 5 (14) shows the Anti-Vibe Diffusion Bumps™ that prevent vibrations from being transmitted through the subfloors when the washer and dryer are operating. The Anti-Vibe Diffusion Bumps, small hollow or solid bumps of irregular sizes each connected to another by bridge-like 'transferring strands' spread over the entire bottom of the pan, are designed to disperse downward vibration from washers or dryers horizontally towards the outer edge of the pan so as to prevent or minimize vibration from going down through the floor. The Anti-Vibe Diffusion Bumps keep the vibrations from moving downward thus preventing noise projected downward through the floor.

FIG. 2 (13) shows The Anti-Vibe Damping Pads™ which also prevent vibrations from being transmitted through the subfloors and prevent the washer and dryer from shaking, moving and damaging one another. The Anti-Vibe Damping Pads, molded into the pan and positioned where the feet of the washer or dryer are located, are raised, hollow bumps with a flat surface top, that create a hollow air chamber between the feet of the appliance and the floor beneath. This hollow air chamber creates a barrier of air that minimizes or neutralizes the transmission of vibration from the appliance to the floor below. Reducing contact with the floor in this manner disperses the energy across a wide area, resulting in minimal noise and vibration transmission to the floor and through the floor.

To allow the increasingly popular pedestal drawers to clear the front wall of the pan when opening, while also maintaining a large capacity to contain leakage, the Anti-Vibe Damping Pads can be molded to a greater height; this can also be done with simple pads that do not incorporate the Anti-Vibe Damping Pad design.

FIG. 2 (15) shows the Easy-Slide Wedges™ that allow for easy transition and location of appliances during installation. The Easy-Slide Wedges are molded into the inside front edge of the pan design, providing both a strengthening buttress to the front wall aw well as a place for the appliance's feet to rest on once the machine is picked up and over the front lip of the pan. These wedges make it possible for the installer to set the rear feet of the appliance down on the top of the wedge and take a pause/rest from lifting the machine, and further to use the wedges as a guide as one slides the machine safely down the wedges to the bottom of the pan, preventing strain from lifting the machine while also preventing possible damage to the pan or machine if the machine were to be let down hard.

It can readily be seen that the wedges can be made in a variety of widths and lengths/angles—the latter two qualities clearly interdependent, as shortening the wedges used with a given front wall height will increase the angle, and diminishing the angle will accordingly lengthen the wedge. This interdependency illustrates a tension in design requirements, because it is helpful to have the angle of the wedge be as small as possible, while at the same time having the wedge be as short as possible. Because the feet of the appliance must all sit evenly on the floor of the pan (or the optional pads described above) to avoid having the appliance be tilted, and it is functionally and esthetically undesirable to have the pan extend forward beyond the front of the appliance(s), it is optimal to have the length of the wedges be equal to, or slightly smaller than, the distance from the front of the appliance to the front edge of the front feet. When used in conjunction with the optional pads described earlier, the wedges would angle down only to the level of the pads, rather than continuing all the way to the floor of the pan. With raised pads it would optionally be helpful to include additional wedges toward the rear of the pan that would angle up from the floor of the pan to the rear pads, to aid in sliding the rear feet of the appliance up onto the rear pads; these rear wedges could, it can readily be seen, be made considerably longer than the front wedges, if desired, so as to make to sliding easier.

As aforementioned and in addition to the service and repair strip safety device, it may also be optionally helpful to add a hole for water or liquid drainage if necessary (12) for the installer and/or service repair person to drain water or liquid if needed. Many laundry areas in homes are equipped with drains, but for a variety of reasons—such as the location of hookups, or the orientation of appliance doors—it may not be desirable to install the washing machine directly over such a drain. In the most common situation, there is space for two appliances, and if the washer is put in the "other" position, with the dryer positioned over the drain, any leakage from the washer would issue onto, and potentially damage, the floor before hopefully making its way to the drain.

Even when the washer is installed over the drain, leakage can issue from the dryer. Overloading and/or use with a clogged lint filter and/or exhaust duct can cause the dryer's evaporator and/or heating coil element to over work them selves and fail or perhaps break, and water or moisture from the wet/damp clothes can seep through the tumbler seal(s) and leak down through the inner tumbler panel wall of the dryer.

Furthermore, even when the leaking appliance is located over the drain, there is no guarantee that leakage from the appliance will drip directly into the drain, so damage to the surrounding floor is still a danger. Equipping the floor of the pan with a hole directly over the drain, by drilling or otherwise, makes sure that any leakage is conducted directly down the drain, with no danger of damage to the surrounding floor regardless of how the appliances are situated.

In one further variation, the basin can be equipped with a particularly tall wall—most handily as a separate piece fitting inside the basin, and on the back of the basin, so that this tall wall extends right up to the water supply pipes. This tall wall can thus protect the plaster or wallboard room wall behind it if the hose fitting at either the hose bib or the washing machine starts to leak and spray, and will guide that spray down to the basin. In a particularly useful variation on this idea, this tall wall could be equipped, at its upper end, with a series of horizontal score lines or other means to permit the easy removal of part of the height of this wall to allow it to fit the particular height of the water supply pipes. Should these water supply pipes not be on the same side of the washing machine as the machine's water intake fittings, the basin could obviously be equipped with more than one particularly tall wall. It can also be understood that it may not be advantageous for such particularly tall wall(s) to extend to the dryer, as well, both because the dryer is unlikely to develop any kind of liquid leak that would spray against a wall, and also because such a wall could interfere with dryer vent pipe, so such particularly tall wall is most likely narrower than the basin as a whole.

Those skilled in the art will understand that there are numerous materials that can be utilized to mold the dual automatic dryer and washing machine protective basin, (in its simplest form, "leak pan") and the repair strip safety device. The materials and methods disclosed herein are the preferred materials and methods respectively. In addition, this invention can, of course, be practiced to fit stackable appliances or even a single appliance.

We claim:

1. A system for collecting leakages from at least one washing machine and at least one dryer, the system comprising:

a plurality of opposing side walls engaging with a front wall, a rear wall and a substantially flat bottom panel to define a basin structure having a void interior, said basin structure being sized to contain at least one washing machine and at least one dryer and being capable of containing liquid;

and at least one detachable slide wedge which engages with the front wall to provide strength to the at least one front wall;

whereby the at least one detachable slide wedge is adapted to enhance the transition, location and installation of the at least one dryer and at least one washing machine.

2. The system of claim 1, wherein said basin structure is sized to contain liquid in an amount at least equal to the capacity of said at least one washing machine.

3. The system of claim 1, wherein the basin structure includes at least one hole designed for diverting and effectively removing from the basin structure.

4. The system of claim 1, wherein the substantially flat bottom panel includes a plurality of flanges to receive support legs of the at least one washing machine and at least one dryer.

5. The system of claim 4, wherein said flanges are formed to permit a drawer, of a pedestal drawer structure placed below said at least one washing machine and/or said at least one dryer, to clear said front wall.

6. A system for collecting leakages from at least one washing machine and at least one dryer, the system comprising:

a plurality of opposing side walls engaging with a front wall, a rear wall and a substantially flat bottom panel to define a basin structure having a void interior, said basin structure being sized to contain at least one washing machine and at least one dryer and being capable of containing liquid;

and at least one safety edge and/or safety corner adapted to engage with one or more top edges of the plurality of opposing side walls, the front wall and the rear wall;

whereby the at least one safety edge and/or safety corner provides thicker material and is formed to not be sharp-edged, both to provide greater strength to the wall top edges and to pose less danger to users.

7. The system of claim 6, wherein said basin structure is sized to contain liquid in an amount at least equal to the capacity of said at least one washing machine.

8. The system of claim 6, wherein the basin structure includes at least one hole designed for diverting and effectively removing from the basin structure.

9. The system of claim 6, wherein the substantially flat bottom panel includes a plurality of flanges to receive support legs of the at least one washing machine and at least one dryer.

10. The system of claim 9, wherein said flanges are formed to permit a drawer, of a pedestal drawer structure placed below said at least one washing machine and/or said at least one dryer, to clear said front wall.

11. A system for collecting leakages from at least one washing machine and at least one dryer, the system comprising:

a plurality of opposing side walls engaging with a front wall, a rear wall and a substantially flat bottom panel to define a basin structure having a void interior, said basin structure being sized to contain at least one washing machine and at least one dryer and being capable of containing liquid;

and at least one damping means secured to the substantially flat bottom panel to damp and attenuate wave motion characteristics associated to the at least one dryer and/or the at least one washing machine.

12. The system of claim 11, wherein said basin structure is sized to contain liquid in an amount at least equal to the capacity of said at least one washing machine.

13. The system of claim 11, wherein the basin structure includes at least one hole designed for diverting and effectively removing from the basin structure.

14. The system of claim 11, wherein the substantially flat bottom panel includes a plurality of flanges to receive support legs of the at least one washing machine and at least one dryer.

15. The system of claim 14, wherein said flanges are formed to permit a pedestal drawer placed below said at least one washing machine and/or said at least one dryer to clear said front wall.

16. The system of claim 11, wherein said at least one damping means is a vibration diffusion pad designed to damp and attenuate vibration, shock, noise and movement.

17. The system of claim 16, wherein there are a plurality of vibration diffusion pads, said pads being positioned to engage the support legs of said at least one washing machine and/or said at least one dryer, and formed to permit a drawer, of a pedestal drawer structure placed below said at least one washing machine and/or said at least one dryer, to clear said front wall.

* * * * *